United States Patent [19]

Arney

[11] Patent Number: 4,753,620

[45] **Date of Patent: * Jun. 28, 1988**

[54] FLOATING RESCUE APPARATUS

[76] Inventor: Donald B. Arney, Suite 1001-2191 W. 39 Avenue, Vancouver, British Columbia, Canada, V6M 1T7

[ * ] Notice: The portion of the term of this patent subsequent to Feb. 10, 2004 has been disclaimed.

[21] Appl. No.: 9,749

[22] Filed: Feb. 2, 1987

Related U.S. Application Data

[63] Continuation-in-part of Ser. No. 689,167, Jan. 7, 1985, Pat. No. 4,642,061.

[51] Int. Cl.[4] ..... B63C 9/00

[52] U.S. Cl. ..... 441/83

[58] Field of Search ..... 441/38–40, 441/43–44, 80, 83; 114/345, 349, 338; 244/137 P

[56] References Cited

U.S. PATENT DOCUMENTS

| | | | |
|---|---|---|---|
| 1,052,323 | 2/1913 | Davis | 114/349 |
| 2,738,939 | 3/1956 | Johnson | 441/83 |
| 3,026,545 | 3/1962 | Brainard | 441/80 |
| 3,176,327 | 4/1965 | Oberth | 441/83 |
| 3,228,044 | 1/1966 | Mattenson | 441/83 |
| 3,421,165 | 1/1969 | Pugh | 441/83 |
| 3,771,750 | 11/1973 | Strayer | 441/83 |
| 4,166,462 | 9/1979 | Ellis | 114/338 |
| 4,231,131 | 11/1980 | Young | 114/61 |
| 4,642,061 | 2/1987 | Arney | 441/83 |

FOREIGN PATENT DOCUMENTS

| | | | |
|---|---|---|---|
| 527063 | 7/1956 | Canada | 441/40 |
| 624825 | 9/1978 | U.S.S.R. | 441/83 |

*Primary Examiner*—Sherman D. Basinger
*Assistant Examiner*—Jesûs D. Sotelo
*Attorney, Agent, or Firm*—Bull, Housser & Tupper

[57] ABSTRACT

Rescue apparatus for rescuing a person in water has a body with inflatable pontoons interconnected by an upwardly bowed upper connector and a downwardly bowed lower connector to provide an opening between the pontoons to receive the person. Thrusters cooperate with the lower connector below the surface, and receive power and control signals to control movement of the apparatus on the surface. A net enclosure encloses the pontoons and connectors and has an opening adjacent one end to receive the person. The upper portion of the apparatus is lighter than the lower portion, to provide a low center of gravity for self-righting if the apparatus becomes inadvertantly inverted. Self-righting can be assisted by providing inflatable flotation cooperating with the upper connector. The connectors are shaped to fit closely adjacent each other to reduce storage volume of the collapsed apparatus when the pontoons are deflated. The apparatus is designed for storage within a helicopter, and can be retrieved from the water by a helicopter with a lifting line positioned so as to permit relatively easy unloading of the person from the apparatus into the helicopter. The apparatus can be used also from ships, oil drilling rigs etc. The folded or collapsed apparatus can be thrown onto water, and it inflates and erects automatically without manual intervention.

15 Claims, 6 Drawing Sheets

FIG. 3
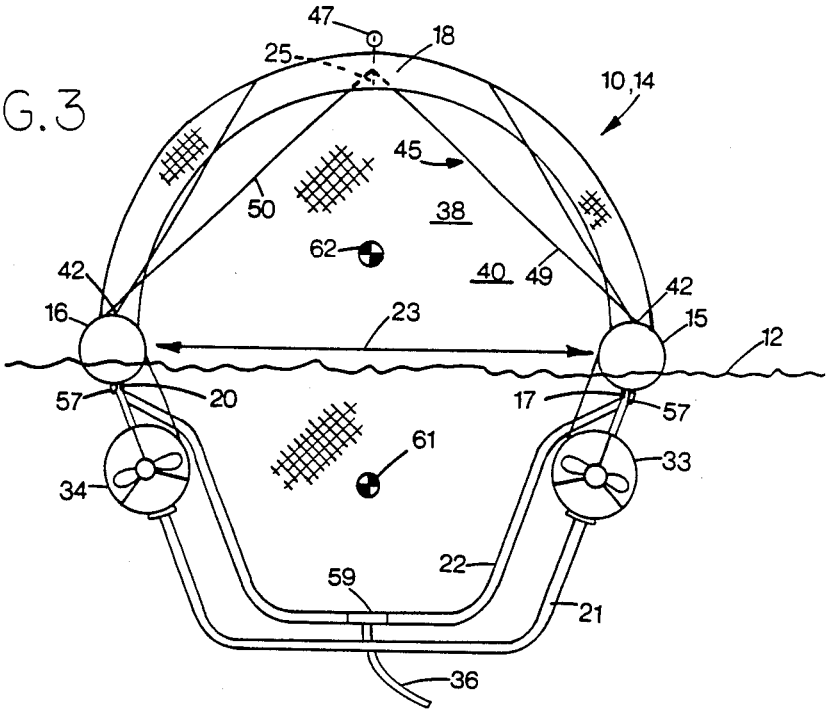
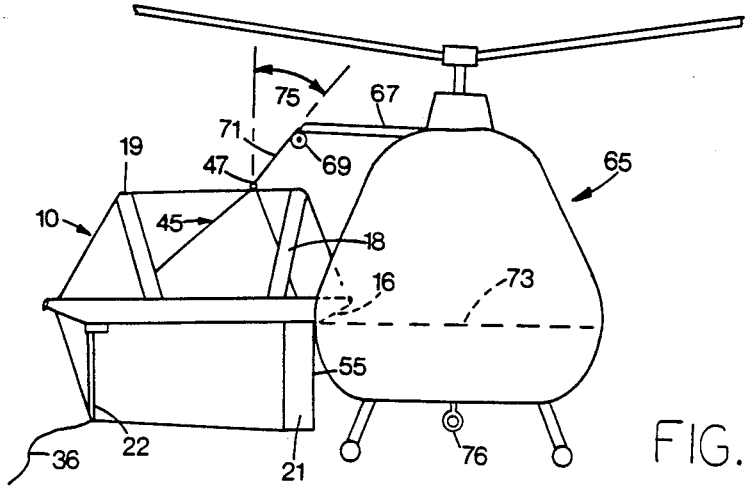
FIG. 4

FLOATING RESCUE APPARATUS

CROSS REFERENCES TO RELATED APPLICATIONS

This is a continuation-in-part of my copending patent application Ser. No. 689,167 filed Jan. 7, 1985 entitled "Personnel Rescue Apparatus for Use on Water", now U.S. Pat. No. 4,642,061.

BACKGROUND OF THE INVENTION

1. Field of the Invention

The invention relates to a rescue apparatus for rescuing a person in water, particularly for use in adverse weather and sea conditions where conventional rescue craft cannot operate very effectively.

2. Prior Art

Rescue of personnel in adverse weather and sea conditions has always presented difficulties. Conventional rigid or inflatable lifeboats are commonly difficult to manoeuver for retrieving a floating victim, and in fact sometimes are hazardous to the floating victim. Helicopters have been used to lower rescue personnel, or nets, to retrieve victims, but severe weather conditions endanger the rescue personnel and would commonly prohibit the use of helicopters for this type of rescue.

Russian Pat. No. 624,825 discloses a remotely powered and controlled, unmanned floating rescue net which is designed to retrieve a victim from the water by catching the victim in the forward portion of the net, and returning the victim to a rescue vessel. The apparatus of this patent appears to disclose a rigid framework which supports upper and lower portions of a net, with thrusters mounted on each side for controlling and powering the apparatus. The apparatus has remotely inflatable chambers positioned below the lower portion of the net, which chambers are normally deflated so as to permit the net to pass underneath the victim, and are then inflated to raise the victim with the net. The apparatus is disclosed for use with a helicopter, but it has a hollow frame for containing compressed air and does not appear to be collapsible, and thus would require a relatively large and powerful helicopter for operation. Furthermore, there appears to be no automatic self-righting tendency for the apparatus, and should it become inverted in heavy seas or during deployment there may be considerable difficulty in setting it upright again. Furthermore, the hollow frame could be a hazard to the victim in adverse sea conditions where the apparatus could be thrown on top of the victim by large waves.

SUMMARY OF THE INVENTION

The invention reduces the difficulties and disadvantages of the prior art by providing a rescue apparatus which is relatively lightweight, and thus can be deployed and retrieved by a helicopter which is less powerful than that required for use with the prior art Russian apparatus. Furthermore, certain components of the apparatus are inflatable, which permits easy collapsing of the apparatus to reduce storage volume, which permits the apparatus to be stored inside a small helicopter for transportation to the rescue site. The apparatus can be erected automatically from the folded state without manual intervention, and thus could be thrown in the folded state into the sea from a vessel or helicopter whereupon it would quickly erect itself. Clearly, the use of inflatable structure provides automatic flotation and reduces considerably weight of the apparatus, thus presenting less hazard to the victim. Also, the apparatus is designed so that relatively heavy portions are disposed below the water surface, and lightweight portions are disposed above the water surface, thus providing an automatic, self-righting tendency, should the apparatus be temporarily inverted. The loaded apparatus can be hoisted up to the helicopter, and the victim removed with little tendency for the apparatus to move away from the helicopter.

A rescue apparatus according to the invention is for rescuing a person on the surface of a body of water, and has a body, thrusters and a net enclosure. The body has laterally spaced apart, first and second elongated inflatable pontoons, and upper and lower connecting means interconnecting the pontoons to maintain the pontoons essentially parallel. The upper and lower connecting means are bowed upwardly and downwardly respectively to provide an opening between the pontoons to receive the person. First and second thrusters cooperate with the lower connecting means so as to be below and adjacent the first and second pontoons respectively, and simultaneously below the water surface when the apparatus floats thereon. The thrusters are adapted to receive power and control signals to control movement of the apparatus on the surface. The net enclosure cooperates with the pontoons and the connecting means and has an opening adjacent at least one pair of adjacent ends of the pontoons to receive the person. Flotation means cooperate with the upper connecting means, and the thrusters are positioned sufficiently below the pontoons to provide a relatively low centre of gravity for the body to assist in self-righting of the apparatus should the apparatus tip.

In one embodiment, the upper connecting means includes axially spaced forward and aft inflatable arch members to provide the flotation, and the lower connecting means includes axially spaced forward and aft generally U-shaped connecting members which are rigid and shaped so as to fit closely adjacent each other to reduce storage volume of the collapsed apparatus when the pontoons and arch members are deflated. In a second embodiment, the upper connecting means is a lightweight rigid non-inflatable arch member, and the lower connecting means is a heavier, rigid U-shaped member which are shaped to fit closely adjacent each other to facilitate folding and storage. An umbilical power cable is attached adjacent a stern of the apparatus to power and control the thrusters which are mounted forward on the connecting means and are faired with the connecting means to reduce chances of the umbilical cable accidentally interfering with the thrusters.

A detailed disclosure following, related to drawings, describes preferred embodiments of the apparatus, which is capable of expression in structure other than that particularly described and illustrated.

DESCRIPTION OF THE DRAWINGS

FIG. 3 is a simplified front elevation of the apparatus of FIG. 1, shown inflated, FIG. 4 is a simplified front view of the apparatus shown supported by and adjacent a helicopter.

DETAILED DISCLOSURE

Figure 1:
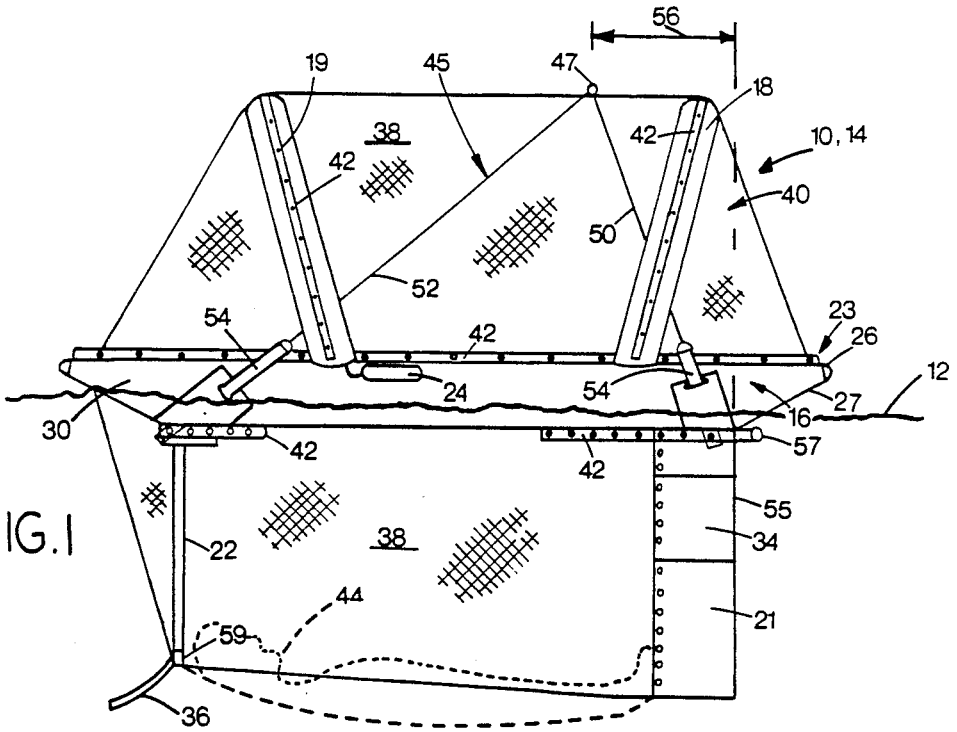
FIG. 1 is a simplified side elevation of a first embodiment of the apparatus according to the invention shown inflated.
Figure 2:
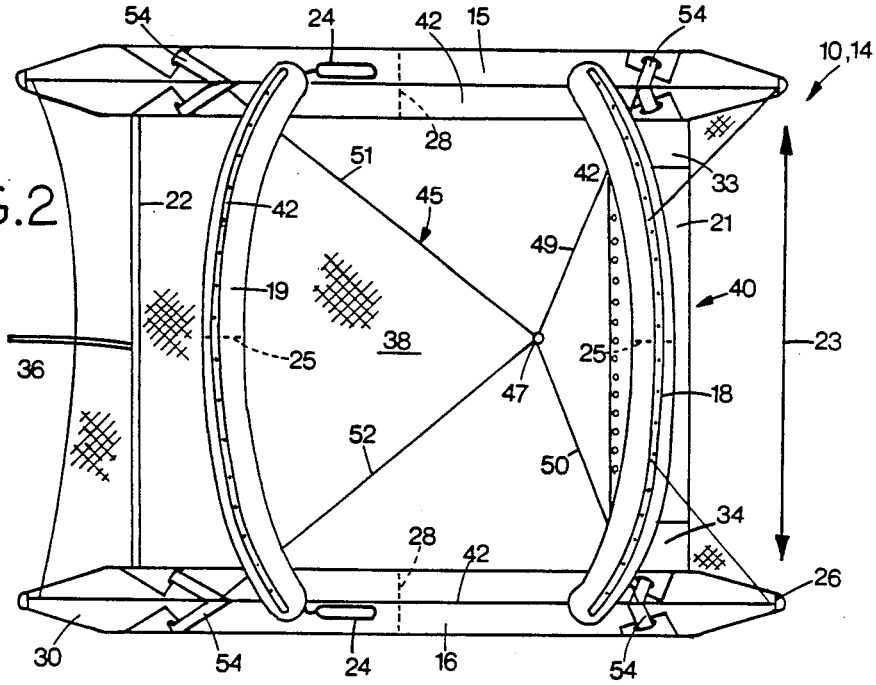
FIG. 2 is a simplified top plan of the apparatus of FIG. 1, shown inflated.
Figure 5:
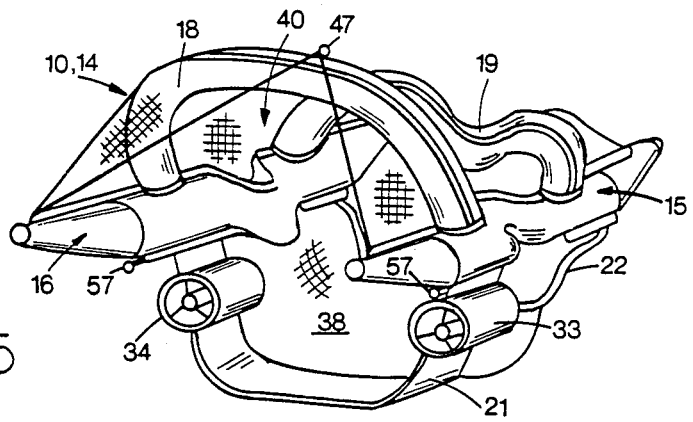
FIG. 5 is a simplified perspective of the apparatus, after partial deflation shown in a partially collapsed state.
Figure 6:
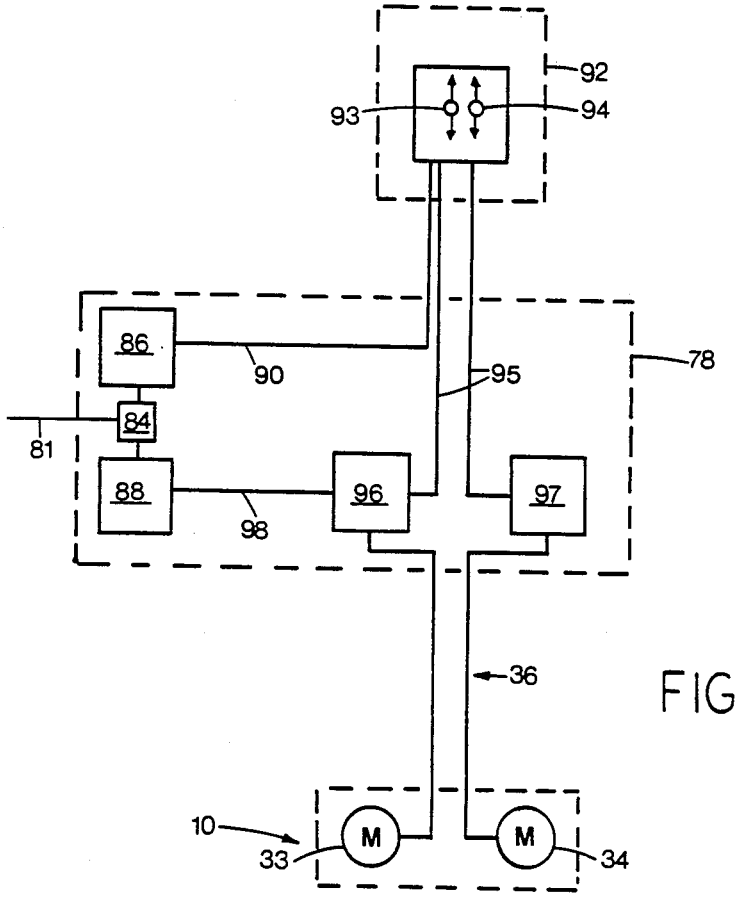
FIG. 6 is a simplified electrical schematic of power and control means for use with the invention.

FIGS. 1 through 3

A rescue apparatus 10 according to the invention is shown floating on the surface 12 of a body of water. The apparatus has a body 14 having laterally spaced, first and second elongated inflatable pontoons 15 and 16 respectively. The body also has axially spaced, forward and aft inflatable arch members 18 and 19 which are generally similar and are bowed upwardly and interconnect the pontoons, as best seen in FIG. 3. The apparatus has axially spaced forward and aft lower connecting members 21 and 22 which are rigid to maintain the pontoons parallel to each other, and generally U-shaped and of a generally similar size so as to fit closely adjacent each other, or with one generally within the other for storage as will be described. As shown, the forward connecting member 21 is larger than the aft connecting member 22 so as to permit the member 22 to fit partially within the member 21 when required for storage. Upper portions of the members 21 and 22 can be secured to generally radially and downwardly extending fabric flanges 17 and 20 of the pontoons 15 and 16, e.g., by nuts and bolts. It can be seen that the members 18 and 19, and 21 and 22, provide upper and lower connecting means respectively which interconnect the pontoons and are bowed upwardly and downwardly respectively to provide an opening 23 between the pontoons to receive the person, not shown. The opening 23 can be about 2 meters wide to receive a person floating horizontally and transversely of the apparatus. The inflatable arch members 18 and 19 communicate with the pontoons so as to receive pressurized air from the pontoons, the pontoons receiving pressurized air from compressed gas bottles 24 secured to the pontoons. The arch members and pontoons are fitted with internal baffles 25 and 28 respectively, shown in broken outline, to form four separate compartments which are sealed from each other. Each compartment is inflatable through a splitter valve connected to the respective adjacent compressed gas bottle. Following common practice, each compartment has a relief valve and a top up/dump valve, none of the valves being shown. The pontoon 16 has a forward portion 26 with an upwardly and forwardly extending prow portion 27, shaped to resemble the forward portions of conventional inflatable boats. The pontoon 16 has a similarly shaped rear portion 30. The pontoon 15 is generally similar to the pontoon 16, and it can be seen that the pontoons resemble the pontoons of conventional inflatable boats.

The apparatus has first and second thrusters 33 and 34 mounted on opposite portions of the forward lower connecting member 21 so as to be axially aligned with the apparatus and to be positioned simultaneously below the water surface 12 when the apparatus floats thereon. The thrusters 33 and 34 are positioned so as to be below and adjacent the first and second pontoons 15 and 16 respectively. The thrusters are adapted to receive power and control signals from an umbilical power cable 36, so as to control movement of the apparatus on the surface as will be described. The umbilical power cable is attached to the aft lower connecting member 22 so as to be remote from the opening 23 at the forward portion of the apparatus. As best seen in FIG. 3, the thrusters have hollow cylindrical bodies which are faired with the connecting member, so that one half only of thruster projects outwardly from the apparatus, which reduces changes of the umbilical cable accidentally interfering with the thrusters. The thrusters have ducted propellers, which are powered by reversible electric motors of nominally about two horsepower each, and are fitted within ducts of about 30 centimeters outside diameter. The thrusters are provided with wire grids over open portions thereof, so as to reduce chances of injury to the person being rescued, and to reduce ingress of seaweed and/or flotsam.

A net enclosure 38 encloses the pontoons and the connecting means, i.e., the forward and aft arch members 18 and 19, and the forward and aft lower connecting members 21 and 22, and has an opening 40 adjacent the opening 23 between forward portions of the pontoons. The apparatus is illustrated with one opening, which is adjacent to at least one pair of adjacent ends of the pontoons, so as to form a closed-ended tunnel to receive the person, but an apparatus having openings at both ends is envisaged, and might be practical for certain applications. The net is sufficiently strong to resist forces of a person being held within the enclosure, and has a grid size or mesh sufficiently small to reduce chances of a person's finger or limb being trapped within openings of the mesh. Also, the net is secured by lacing means, severally 42, which extend along the pontoons and connecting means to secure the net positively where it contacts the pontoons and connecting means. The lacing means 42 can be elongated fabric strips extending radially as flanges from the pontoon or arch member and having a row of eyelets to receive string or cord which is threaded through the net to secure the net to the strips. Most of the net is stretched relatively tightly between the connecting means and pontoons, and serves as a stiffening structure or shear web to reduce movement, particularly between the relatively flexible inflatable arch members 18 and 19. Similarly, because there is a continuous area of net extending rearwardly from the front connecting member 21 to the rear of the pontoons, thrust from the thrusters acting on the connecting member is resisted by the net, thus maintaining the connecting member 21 in the required essentially perpendicular position as shown in FIG. 1. However, some "fullness" or "looseness" is provided in the lowermost portion of the net so that it can bow downwardly as shown in broken outline in FIG. 1, when a person 44 (broken outline) is carried in the net and the apparatus is suspended in air. The fullness ensures the person is positioned below the lowermost portion of the member 21, and thus will not accidentally slide out of the apparatus. Thus, the net enclosure serves two purposes, namely for containing a rescued person, and, because it is secured to the upper and lower connecting means and the pontoons it also reduces movement between the connecting means and the pontoons.

The apparatus 10 is designed to be carried by helicopter, or a hoist extending from the deck of a vessel or other platform, and is provided with a lifting harness 45 fitted with an upper lifting ring 47. The harness 45 includes a pair of forward cables 49 and 50 and a pair of aft cables 51 and 52. The four cables extend from the ring 47 downwardly to respective strapping slings, severally 54, which pass around adjacent portions of the first and second pontoons. The slings diffuse loads into the pontoons, so as to reduce stress and chances of rupture. The relative lengths and positions of the forward and aft cable pairs are such that the lifting ring 47, which serves as a lifting means, is positioned above the upper connecting means, and also aft of a leading portion 55 of the forward lower connecting member 21 by a spacing 56. The leading portion 55 is also positioned aft of the forward portions, e.g., 26, of the pontoons and this has a particular advantage as will be described with reference to FIG. 4. A forward ring 57 is positioned adjacent the forward portion 26 of the pontoon 16 and a similar ring is fitted on the pontoon 15. A bridle, not shown, can extend as a slack loop between the forward rings to provide an alternative or additional lifting or towing harness.

Being inflatable, the upper connecting means are lighter than the lower connecting means to provide a relatively low centre of gravity of the body. Ballast 59 is also preferably provided at a lowermost mid-position of the aft lower connecting member 22, which, in combination with the relatively heavy thrusters 33 and 34, lowers the centre of gravity of the apparatus to a relatively low position, designated 61 in FIG. 3. Because the centre of gravity is positioned well below the centre of buoyancy, which is positioned approximately at 62, the apparatus has a strong self-righting tendency, or resistance to being turned upside down, which might otherwise occur if the centre of gravity were higher. In general, every attempt is made to produce a light apparatus, for easily handling by a helicopter, and to be less of a hazard to the victim. Also, any relatively heavy item should be positioned as far below the waterline as possible to contribute to a low centre of gravity.

FIG. 4

A helicopter 65 has a winch arm 67 extending transversely thereon, and carrying winch means 69 at an outer end thereof. The apparatus 10 is shown hanging from a lifting line 71 which is connected to the ring 47 and extends to the winch, and the forward portion 26 is shown being partially supported on the floor 73 of the cargo hatch of the helicopter. The floor serves as a receiving surface for the forward portions of the pontoons which extend upwardly and forwardly from the leading portion 55 of the lower connecting means. It can be seen that the lifting line 71 is inclined at an angle 75 to the vertical at the ring 47. This angle is dependent on the relative positions of the winch 69, the ring 47 and the leading portion 55 of the lower connecting means and is important as this angle generates a resultant horizontal component of force on the apparatus 10 which tends to hold the apparatus into the helicopter. This is helpful in steadying the apparatus when a person is being unloaded therefrom into the helicopter, which can be done when the helicopter is hovering. Thus the relative position of the leading portion 55 of the lower connecting means, which is aft of the forward portion of the pontoons, permits the forward end of the pontoons to be supported on the receiving surface to facilitate unloading of the apparatus, and positioning the lifting means aft of the leading portion 55 produces a force from the lifting line which tends to draw the apparatus forwardly onto the receiving surface, reducing a tendency of the apparatus to swing away from the helicopter. This unloading arrangement is feasible only for use with helicopters which can tolerate relatively high off-axis forces generated by the lateral position of the apparatus 10. Alternatively the apparatus 10 can be hung from the conventional central cargo hook 76 and unloaded onto a flat surface. Clearly a vessel or platform could be fitted with the arm 67 and the winch 69 for rescue without a helicopter.

FIG. 5

As previously stated, the apparatus can be easily folded to occupy a relatively small space for ease of storage, and to permit transportation by a relatively small helicopter. The apparatus is shown with the forward and aft arch members 18 and 19 and both pontoons 15 and 16 partially deflated, and the forward and aft lower connecting members 21 and 22 have been moved towards each other prior to folding or nesting. When completely folded, the aft connecting member 22 fits generally within or closely adjacent the forward connecting member 21, and the pontoons and arch members are folded to produce a compact package which can be fitted within a relatively small helicopter, such as the Bell 206 Jet Ranger, or can be easily stored on the deck of a small vessel, platform etc. The apparatus has a weight of approximately 45 kilogrammes and clearly can be easily transported by a small helicopter or vessel.

FIG. 6

The umbilical power cable 36 extends from motors of the first and second thrusters 33 and 34 to a power supply and motor control box 78. The box can be fitted on a helicopter, platform or rescue vessel and is supplied with electrical power through a supply line 81, which itself receives power from a generator or other supply. The box contains a ground fault breaker 84 which is connected to a transformer rectifier 86 and a rectifier 88. The transformer rectified 86 is connected through lines 90 to a hand held motor control unit 92 which has toggle switches 93 and 94 for the first and second thrusters respectively. The switches are connected through lines 95 to on/off, forward and reverse relays 96 and 97 which are directly connected to the umbilical power cable 36, and are supplied with power through a line 98 from the rectified 88.

It is considered that the umbilical cable would be approximately 30 to 50 meters long, so as to provide sufficient manoeuvrability from the rescue vessel or helicopter. For this length of line, it has been found that power supply voltages of the order of 110 volts are preferred, so as to reduce line losses. Each motor has forward, neutral and reverse modes for manoeuvring, and clearly the thrusters can be operated simultaneously in opposite directions in a manner similar to operating a twin track crawler vehicle, for steering by rotating about a vertical axis of the apparatus.

OPERATION

The apparatus would normally be carried folded on the deck of the vessel or inside the helicopter to the scene of a rescue. If the vessel or helicopter is sufficiently large, the apparatus is inflated on board and then lowered onto the water. Alternatively, the apparatus could be deployed by lowering it deflated from the vessel or helicopter, and inflating it remotely when on the surface using prior art remote inflation means to control the gas bottle 24. The line 71 and umbilical cable 36 are provided with sufficient slack to enable manoeuvring as required. The umbilical cable 36 extends from the apparatus to the hand held motor controls in the helicopter, and the onboard operator directs the movement of the apparatus towards the person in the water. There is no requirement for changing flotation of the apparatus as it "catches" the person, thus contrasting with the prior art Russian device. The operator merely manoeuvres the apparatus so that the person passes through the opening 23, which has sufficient vertical depth e.g. about 1.5 metres to accommodate a person floating in the normal partially inclined position. It is added that the lower portion of the forward connecting member 21 is positioned to engage the person so inclined at a position about halfway below the thigh or even lower. When the person has passed into the net enclosure itself, the winch 69 is actuated and the person and apparatus are hauled upwards to the helicopter. The apparatus is positioned as shown in FIG. 4 to enable relatively easy removal of the victim from the apparatus. Normally, the apparatus would be tethered by additional lines extending from the forward rings 57 to the helicopter, not shown, to prevent the apparatus from being accidentally pushed away from the helicopter, although the relative positions of the lifting hook and leading portion 55 tend to hold the apparatus into the helicopter. Alternatively, the apparatus could be lifted onto the vessel using the ring 47, or the slack bridle extending between the two forward rings 57 in which a winch line is connected to the bridle.

ALTERNATIVES AND EQUIVALENTS

The apparatus 10 has inflatable forward and aft arch members 18 and 19 which support the upper portion of the net and should have sufficient stiffness to prevent collapsing of the net should the apparatus become inverted. To attain this stiffness, the arch members should be approximately 15–20 centimetres in diameter, when sustaining a pressure of approximately 60 kgs/cm$^2$. Clearly, the size of the arch members can cause a considerable air drag when the apparatus is used in a high wind, and it is preferable to reduce this drag. To reduce the drag, the diameter of the arch members could be reduced, but a higher pressure would be required to obtain sufficient stiffness. Alternatively, an essentially rigid, thinner, non-inflatable metallic or reinforced plastic arch member can be substituted, as shown in the embodiment 100 to be described with reference to FIGS. 7 through 13. In order to reduce drag in air and in the water, other components of the apparatus 10 can be eliminated as described below.

Figure 7:
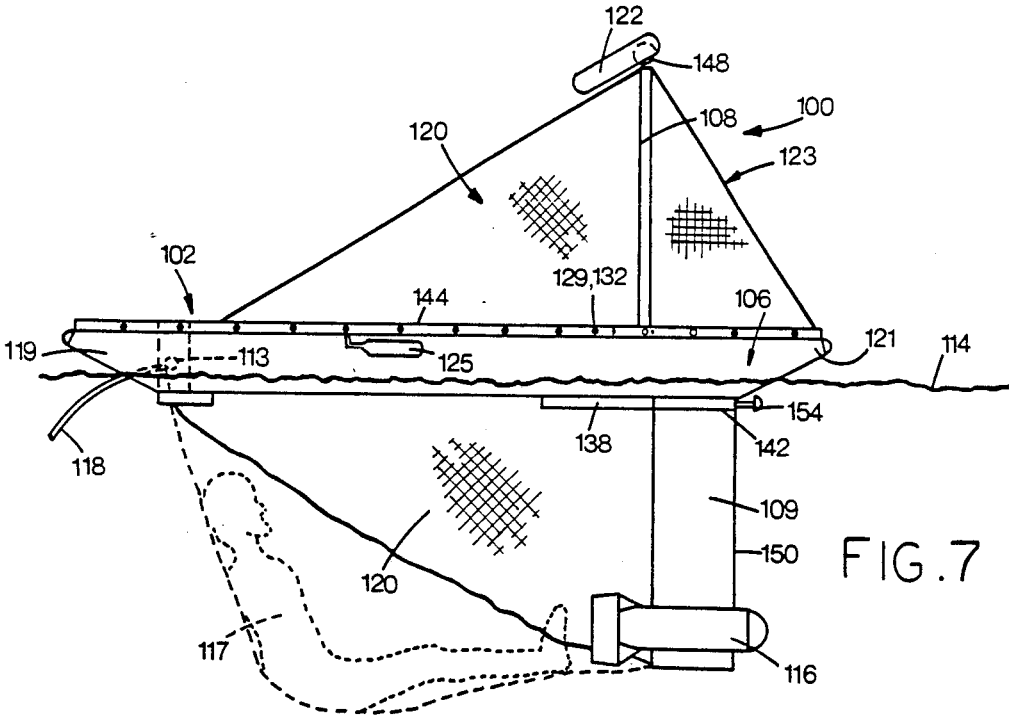
FIG. 7 is a simplified side elevation of a second embodiment of the invention, shown inflated.
Figure 8:
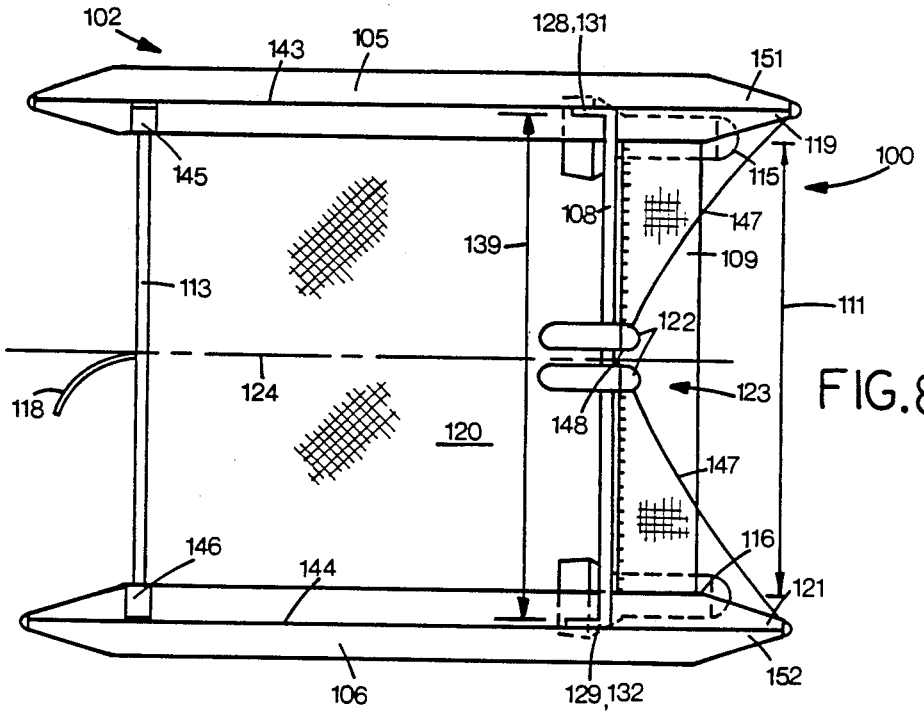
FIG. 8 is a simplified top plan of the second embodiment, shown inflated.
Figure 9:
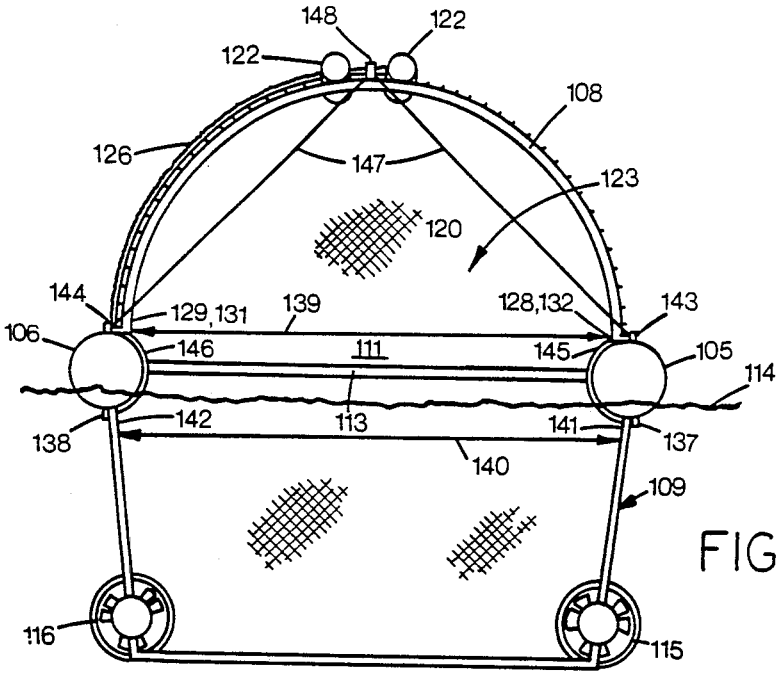
FIG. 9 is a simplified front elevation of the second embodiment, shown inflated.

FIGS. 7 through 9

An alternative apparatus 100 has a body 102, having laterally spaced, parallel, first and second elongated inflatable pontoons 105 and 106, with an upper arch member 108 and a lower U-shaped member 109 interconnecting the pontoons. The members 108 and 109 are essentially rigid and are bowed upwardly and downwardly respectively to provide an opening 111 between the pontoons to receive the person to be rescued. The member 108 serves as an upper connecting member and is preferably lighter than the member 109 which serves as a lower connecting member. Preferably the upper connecting member has a relatively small cross-section to reduce air drag or "windage". An essentially straight, non-inflatable, transversely disposed aft connecting member 113 extends between aft portions of the pontoons to maintain the pontoons parallel and is spaced above the surface of the water 114 to reduce water drag. Clearly, the members 108, and 109 serve as upper and lower connecting means interconnecting the pontoons and are equivalent to the members 18, 19, 21 and 22 of FIG. 1.

First and second thrusters 115 and 116 cooperate with the lower U-shaped member 109 so as to be below and adjacent the first and second pontoons respectively. Preferably, the thrusters are spaced as low as is practicable beneath the pontoons, so as to be simultaneously below the water surface 114 when the apparatus floats and to produce a relatively low center of gravity, similarly to the first embodiment. As before, the thrusters receive power and control signals to control movement of the apparatus on the surface through an umbilical power cable 118 connected to the aft connecting member 113. A net enclosure 120 cooperates with the pontoons and the connecting means and has an opening 123 adjacent forward portions 119 and 121 of the pontoons 105 and 106 to receive the person. As before, the net has sufficient fullness to enable a person 117 (broken outline) to be carried in the net when the apparatus is suspended in air, without the person sliding out of the apparatus. A pair of inflatable floats 122 is secured centrally and adjacent an upper most portion of the arch member 108 and have longitudinal axes aligned with a longitudinal axis 124 of the apparatus. This is to reduce air drag to forward or reverse motion of the apparatus. A compressed gas bottle 125 communicates with the pontoons to inflate them as previously described. A hose 126 extends from the pontoon 106 to communicate with the floats 122 to inflate them as required, and valves and baffles as previously described are provided but not shown.

Figure 10:
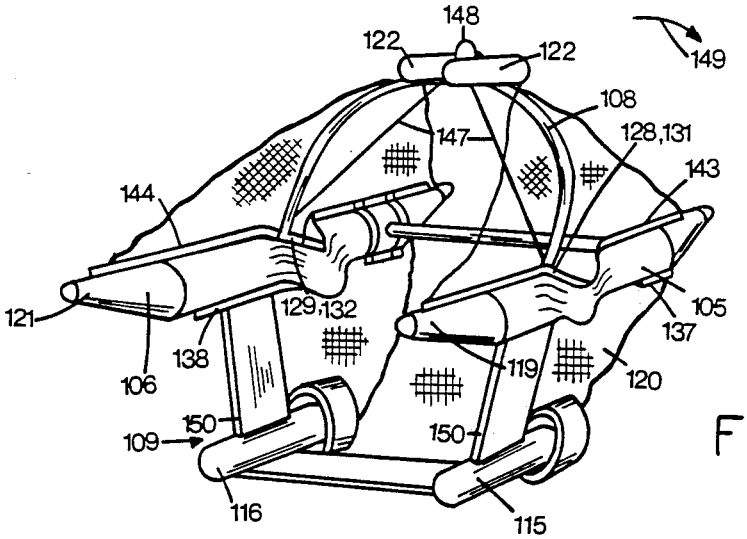
FIG. 10 is a simplified perspective of the second embodiment, shown partially deflated.

In contrast with the apparatus 10 of FIG. 1, the upper connecting means of the apparatus 100 is rigid and thus is not inflatable. Instead the members 108 and 109 preferably are shaped so as to fit one closely adjacent the other in order to reduce storage volume of the collapsed apparatus when the pontoons are deflated, see FIGS. 10–13. Similarly to the members 21 and 22 of FIGS. 1–3, the members 108 and 109 can be of similar size, to fit partially one within the other. As best seen in FIG. 10, the arch member 108 has generally L-shaped lower portions 128 and 129 when viewed from the side. The portions 128 and 129 have relatively short arms 131 and 132 respectively which extend axially rearwardly along the pontoons, as seen in FIG. 8. As seen in FIG. 9, the pontoons 105 and 106 have upper generally radially extending fabric flanges 143 and 144 respectively, which serve as lacing means for the net and are provided with a plurality of openings to which the short arms 131 and 132 of the arch member 108 are secured by nuts and bolts. The short arms 131 and 132 also extend inwardly from the arch member 108 and along the pontoons and have relatively broad horizontal surfaces which contact upper surfaces of the inflatable pontoons to provide stiffness in the joint between the member 108 and the inflated pontoons. Pressure in the pontoons tends to hold the arch member 108 essentially perpendicularly to the pontoons, rigidity being augmented by friction between the net enclosure and the arch member. The pontoons 105 and 106 have lower generally radially extending fabric flanges 137 and 138 to serve as lacing means for the net and to which upper portions 141 and 142 of the U-shaped member 109 are similarly secured.

As will be described, with reference to FIGS. 10–13, when the pontoons are deflated the arch member 108 effectively rotates relative to the lower member 109 so that the one fits generally within or closely adjacent the other. For this purpose, the lower end portions 128 and 129 are spaced apart at a transverse spacing 139 less than spacing 140 between the upper portions 141 and 142 of the U-shaped member 109. This permits the arch member 108 effectively to rotate relative to the U-shaped member 109 to fit closely adjacent the U-shaped member to facilitate packing. Also to facilitate packing, the upper connecting member is not secured to the net enclosure 120 but instead is free to move within the net enclosure. This also facilitates collapsing of the apparatus when deflated, for storage.

The aft transverse member 113 has opposited ends carrying semi-circular sectioned seat members 145 and 146 which engage oppositely facing inner portions of the pontoons 105 and 106. Upper and lower edge portions of the seat members are secured to the upper and lower flanges respectively of the pontoons. A bifurcated lifting harness 147 has lower portions cooperating with portions 119 and 121 of the pontoons, and an upper portion having a lifting ring 148 for attachment to helicopter or other means as before. The ring 148 is also attached to the net enclosure 120, which transfers loads to the pontoons and the member 113 so that the net serves as a rear portion of the lifting harness. With a sufficiently strong net, the harness 147 can be eliminated and the net is then used to carry all lifting loads. The apparatus 100 particularly resembles the apparatus 10 in that the lower connecting means 109 has a leading portion 150 positioned aft of upwardly and forwardly sloping forward portions 119 and 121 of the pontoons 105 and 106 to permit the forward portions of the pontoons to be supported on a receiving surface (e.g., on a helicopter as in FIG. 4) to facilitate unloading of the apparatus. The lifting ring 148 is similarly positioned aft of the leading portion 150 of the member 109 so that force from the lifting line or the ring 148 draws the apparatus forwardly onto the receiving surface. Similarly forwards rings 154 are fitted adjacent the forward portions 119 and 121 and can be used to attach a bridle, not shown, as described with reference to FIGS. 1–3.

FIGS. 10 through 13

The apparatus 100 is used generally similar to the previously described apparatus, except that the upper arch member 108 does not require inflation. However, similarly to the apparatus 10, the apparatus 100 can automatically erect itself, once air is supplied to the pontoons and related structure and is designed to fold away easily for storage.

Figure 11:
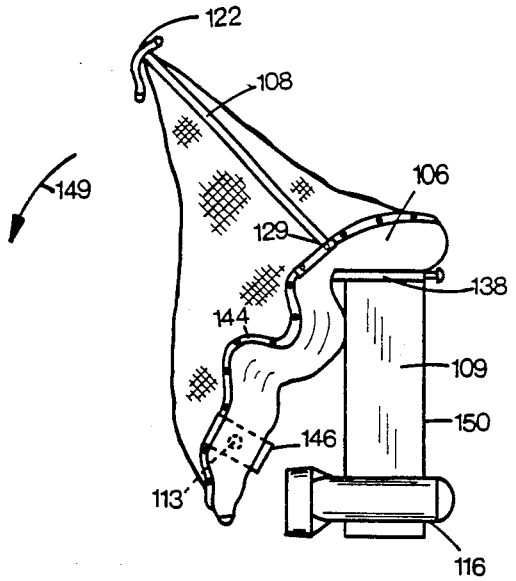
FIG. 11 is a simplified side view of the second embodiment, shown deflated and partially folded.
Figure 12:
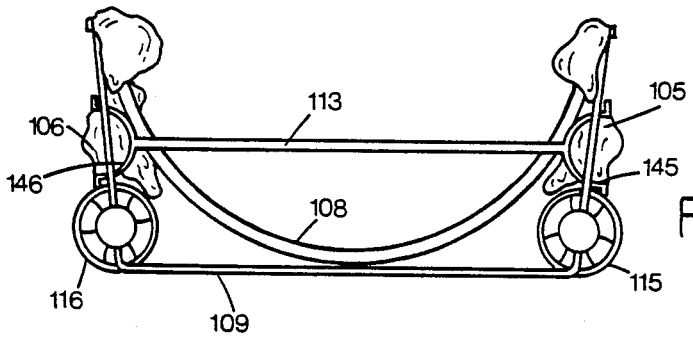
FIG. 12 is a simplified front elevation of the second embodiment shown folded.
Figure 13:
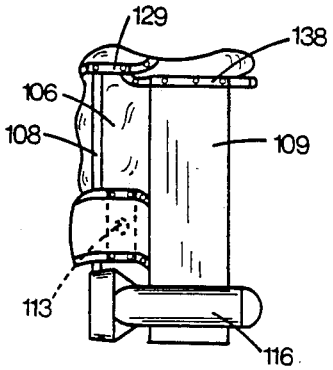
FIG. 13 is a simplified side elevation of the second embodiment shown folded.

FIG. 10 shows the pontoons partially deflated which permits the arch member 108 to start to rotate aft per arrow 149. The "L"-shaped lower portions 128 and 129 are secured to and move with the adjacent portions of upper flanges 143 and 144 and the member 108 tends to slide under the net enclosure. FIG. 11 shows the floats 122 and the pontoons collapsed further with the members 108 and 113 approaching a rear portion of the member 109 as air is removed from the pontoons. FIGS. 12 and 13 show relative positions of main components with the member 113, the pontoons and the net enclosure positioned between the members 108 and 109. This is a fully folded or deflated condition and requires a much smaller volume than the apparatus in the erected state and can be carried in the rear passenger compartment of a small helicopter.

From the deflated condition, the apparatus erects itself in a reverse order and can be thrown folded into water to erect itself without manual intervention, by controlling the bottle 125 remotely as before described. Air is fed into the pontoons from the compressed gas bottle 125, and, as the pontoons expand, the arch member 108 gradually rotates from a retracted position, generally adjacent the connecting member 109, to the fully raised position, by rotation in a direction opposite to the arrow 149. This is due to force being applied to the arch member 108 by air pressure acting on the short arms 131 and 132. As the arch member rises relative to the pontoons, it slides underneath the net enclosure, which is slack at that time. As full pressure is attained in the pontoons, the arch member attains the fully raised position, at which time the net enclosure becomes taut. The apparatus 100 can now be deployed in the rescue, and should it become inverted, the inflatable flotation 122 augments the self-righting tendency of the apparatus due to its low center of gravity. Similarly to the apparatus 10 (FIGS. 1–5), the apparatus 100 can be raised and lowered from a helicopter and unloaded into a helicopter.

I claim:

1. A rescue apparatus for rescuing a person on the surface of a body of water, the apparatus having:

(a) a body having laterally spaced, first and second elongated inflatable pontoons, and upper and lower connecting means interconnecting the pontoons, the upper and lower connecting means being bowed upwardly and downwardly respectively to provide an opening between the pontoons to receive the person, the body also having flotation means cooperating with the upper connecting means to assist in self-righting should the apparatus tip, (b) first and second thrusters cooperating with the lower connecting means so as to be below and adjacent the first and second pontoons respectively, and simultaneously sufficiently below the water surface when the apparatus floats thereon to provide a relatively low centre of gravity for the body to resist tipping and to assist in self-righting should the apparatus tip, the thrusters being adapted to receive power and control signals to control movement of the apparatus on the surface, (c) a net enclosure enclosing the pontoons and the connecting means, the net enclosure having an opening adjacent at least one pair of adjacent ends of the pontoons to receive the person.

2. An apparatus as claimed in claim 1 in which:

(a) the flotation means includes the upper connecting means being inflatable.

3. An apparatus as claimed in claim 1 in which:

(a) the lower connecting means is rigid and is heavier than the upper connecting means to assist in providing the low center of gravity.

4. An apparatus as claimed in claim 3 in which:

(a) the upper connecting means includes axially spaced forward and aft inflatable arch members, and the lower connecting means includes axially spaced, forward and aft generally U-shaped rigid connecting members of generally similar size as to fit closely adjacent each other to reduce storage volume of the collapsed apparatus when the pontoons and arch members are deflated.

5. An apparatus as claimed in claim 1 in which:

(a) the pontoons have upwardly and forwardly extending forward portions, (b) the lower connecting means has a leading portion positioned aft of the forward portions of the pontoons to permit the forward end of the pontoons to be supported on a receiving surface to facilitate unloading of the apparatus.

6. An apparatus as claimed in claim 5 further including:

(a) a lifting means positioned above the upper connecting means and aft of the leading portion of the lower connecting means, so that, when the apparatus is suspended from a lifting line acting from above the receiving surface, force from the lifting line tends to draw the apparatus forwardly on to the receiving surface.

7. An apparatus as claimed in claim 1 in which:

(a) an umbilical power cable is attached to the apparatus to power and control the thrusters, (b) the lower connecting means includes forward and aft generally U-shaped connecting members, (c) the thrusters are mounted on opposite portions of the forward connecting member so as to be axially aligned with the apparatus and to be faired with the forward connecting member to reduce chances of the umbilical cable accidentally interfering with the thrusters.

8. An apparatus as claimed in claim 7 in which:

(a) the opening of the net enclosure is supported by the upper connecting means and extends aft from the opening between forward portions of the pontoons, (b) the umbilical power cable is attached to an aft portion of the apparatus so as to be remote from the opening of the net enclosure.

9. An apparatus as claimed in claim 1 in which:

(a) the net enclosure is secured to the upper and lower frame means and the pontoons to reduce movement between the frame means and the pontoons.

10. An apparatus as claimed in claim 1 in which:

(a) ballast is provided at a lowermost portion of the lower connecting means to lower the centre of gravity of the apparatus.

11. An apparatus as claimed in claim 1 further including:

(a) compressed air inflation bottle means mounted on the apparatus to inflate the pontoons.

12. An apparatus as claimed in claim 1 in which:

(a) the upper and lower connecting means are rigid and are shaped so as to fit closely adjacent each other when the pontoons are deflated, so as to reduce storage volume of the collapsed apparatus.

13. An apparatus as claimed in claim 12 in which:

(a) the upper connecting means is an arch member having lower portions secured to a respective pontoon, (b) the lower connecting means is a generally U-shaped member having upper portions cooperating with a downwardly extending lower flange, adjacent the forward portion of the respective pontoon, (c) a transverse member extends between aft portions of the pontoons to assist in maintaining the pontoons parallel.

14. An apparatus as claimed in claim 13 in which:

(a) the flotation means is inflatable and is secured to an uppermost portion of the arch member.

15. An apparatus as claimed in claim 13 in which:

(a) the lower portions of the arch member have respective short arms extending from the arch member which are secured to the pontoons and axially aligned with the pontoons so as to cause the arch member to rotate relative to the U-shaped member to assist in automatic erection of the apparatus when the pontoons are inflated.

* * * * *